US008025292B2

(12) United States Patent
Takeshita

(10) Patent No.: US 8,025,292 B2
(45) Date of Patent: Sep. 27, 2011

(54) TRANSPORT APPARATUS AND RECORDING APPARATUS

(75) Inventor: Sanshiro Takeshita, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 9 days.

(21) Appl. No.: 12/496,427

(22) Filed: Jul. 1, 2009

(65) Prior Publication Data

US 2010/0001461 A1 Jan. 7, 2010

(30) Foreign Application Priority Data

Jul. 2, 2008 (JP) ..... 2008-173946

(51) Int. Cl.
*B65H 5/04* (2006.01)

(52) U.S. Cl. ..... 271/274

(58) Field of Classification Search ..... 271/274
See application file for complete search history.

(56) References Cited

U.S. PATENT DOCUMENTS

| | | | | |
|---|---|---|---|---|
| 5,540,427 | A * | 7/1996 | Nitta et al. | 271/274 |
| 5,988,635 | A * | 11/1999 | Ohshima | 271/274 |
| 2004/0065993 | A1* | 4/2004 | Kamijoh | 271/121 |
| 2005/0035992 | A1* | 2/2005 | Sugiyama | 347/33 |

FOREIGN PATENT DOCUMENTS

JP 2008-074605 4/2008

* cited by examiner

*Primary Examiner* — Michael McCullough
(74) *Attorney, Agent, or Firm* — Maschoff Gilmore & Israelsen

(57) ABSTRACT

A transport apparatus includes: a transport roller unit that includes a drive transport roller and a driven transport roller to transport a transported medium to a downstream side of a transport direction; a driven roller holder that rotatably holds the driven transport roller; a support member that supports the driven roller holder and allows it to swing; a load applying resilient member that applies a load to the driven transport roller by being resiliently deformed in a direction along which the driven transport roller approaches the drive transport roller; and an engaging member that is provided separately from the support member to bear the load by engaging with the load applying resilient member.

5 Claims, 8 Drawing Sheets

TRANSPORT APPARATUS AND RECORDING APPARATUS

BACKGROUND

1. Technical Field

The present invention relates to a transport apparatus that includes a transfer roller unit having a drive transport roller and a driven transport roller to transport a transported medium to a downstream side of a transport direction, a driven roller holder rotatably holding the driven transport roller, a support member supporting the driven roller holder and allowing it to swing, and a load applying resilient member applying a load to the driven transport roller by being resiliently deformed in a direction along which the driven transport roller approaches the drive transport roller, and a recording apparatus including the transport apparatus.

The recording apparatus includes an inkjet printer, a wire dot printer, a laser printer, a line printer, a copying machine, a facsimile machine, and the like.

2. Related Art

Conventionally, as disclosed in JP-A-2008-074605, a transport apparatus provided in a recording apparatus includes a transport roller unit having a drive transport roller and a driven transport roller. The driven transport roller is rotatably held by a support frame as a driven roller holder. The support frame is supported by an attaching frame as a support member which allows it to swing. Moreover, the transport apparatus includes a coil spring as a load applying resilient member to urge the support frame in a direction along which the driven transport roller approaches the drive transport roller using the urging force of the coil spring.

Specifically, one end arm of the coil spring comes in contact with a driven roller shaft on which the driven transport roller is mounted to urge the driven transport roller. Meanwhile, the opposite end arm of the coil spring engages with the attaching frame. That is, the attaching frame receives the opposite end arm of the resiliently deformed coil spring to urge the driven transport roller so that the driven transport roller can approach the drive transport roller on the side of the end arm of the coil spring. Therefore, a transport force can be applied to the paper held between the drive transport roller and the driven transport roller to transport the paper to a recording section on the downstream side of the transport direction.

However, there is a need to make the shape of the recording apparatus thinner and the height of the attaching frame shorter. Here, since the attaching frame directly engages with the opposite end arm of the coil spring, a large force is applied to the attaching frame. Therefore, when the height of the attaching frame is made short, the attaching frame may be bent and deformed.

Further, since the attaching frame as a support member holds the support frame as a driven roller holder, the relative position between the driven transport roller and the drive transport roller as well as the alignment of the driven transport roller may be unstable. As a result, the transport precision of the paper may be unstable.

Although the attaching frame needs to be made thicker to prevent deformation, the weight of the attaching frame also increases as its thickness increases.

SUMMARY

An advantage of some aspects of the invention is that it provides a transport apparatus that stabilizes transport precision regardless of the strength of a support member which supports a driven transport roller holder in spite of a limit on the size of the transport apparatus, and a recording apparatus including the same.

According to a first aspect of the invention, there is provided a transport apparatus including: a transport roller unit that includes a drive transport roller and a driven transport roller to transport a transported medium to a downstream side of a transport direction; a driven roller holder that rotatably holds the driven transport roller; a support member that supports the driven roller holder while allowing it to swing; a load applying resilient member that applies a load to the driven transport roller by being resiliently deformed in a direction along which the driven transport roller approaches the drive transport roller; and an engaging member that is provided separately from the support member to bear the load by engaging with the load applying resilient member.

According to the first aspect of the invention, the transport apparatus includes the support member and the engaging member. That is, the transport apparatus includes the engaging member provided separately from the support member. Therefore, the load of the load applying resilient member directly influences the engaging member, but does not directly influence the support member. As a result, the support member is prevented from being deformed by the load, and the support member can precisely determine the positions of the driven roller holder and the driven transport rollers. That is, the positions of the driven transport rollers can be stabilized. Therefore, the transport precision of the transported medium by the transport roller unit can be stabilized.

Further, since the load is not directly applied to the support member, there is no need for the functional requirements for prevention of deformation thereof. As a result, the support member does not need to be made significantly thick and heavy.

According to a second aspect of the invention, the support member of the first aspect is formed of a resin.

According to the second aspect of the invention, the support member is formed of a resin in addition to having the same operation and effect as the first aspect of the invention. Therefore, the transport apparatus can be made light as compared with the case in which the support member is formed of a metal sheet.

According to a third aspect of the invention, in the first or second aspect, the load applying resilient member has a plurality of torsion coil springs, and ends at one side of the torsion coil springs engage with the driven roller holder on a side close to the driven transport roller with respect to a swinging support, and the other ends thereof engage with the engaging member.

According to the third aspect of the invention, the load applying resilient member has a plurality of torsion coil springs in addition to having the same operation and effect as the first and second aspects of the invention, and ends at one side of the torsion coil springs engage with the driven roller holder on a side close to the driven transport roller with respect to a swinging support, and the other ends thereof engage with the engaging member.

When the plurality of torsion coil springs are used as in the aspect of the invention, the reaction to the operation of the driven transport rollers by the ends at one side of the torsion coil springs significantly influences the other ends thereof. In this case, the loads of the torsion coil springs are not directly applied to the support member, which is available. That is, the structure is available for a relatively large load.

Further, the ends at one side of the torsion coil springs engage with the driven transport rollers. Here, the load indirectly applied to the swing point of the driven roller holder can be reduced by engaging the ends at one side of the torsion coil springs with the vicinity of the driven transport rollers.

According to a fourth aspect of the invention, in any one of the first to third aspects, a convex portion is formed in at least one of the engaging member and the support member, and the engaging member and the support member make point-contact with each other at the convex portion.

According to the fourth aspect of the invention, a convex portion is formed in at least one of the engaging member and the support member, and the engaging member and the support member make point-contact with each other at the convex portion in addition to having the same operation and effect as the first to third aspects of the invention. Therefore, the position of the engaging member relative to the support member can be determined. As a result, the load applied by the load applying resilient member can be stabilized.

Further, an aperture may be provided between the support member and the engaging member by the point contact. As a result, the deflection of the engaging member rarely influences the support member.

According to a fifth aspect of the invention, there is provided a recording apparatus including: a feeder that picks up a loaded recording medium and feeds the recording medium; a transporter that transports the fed recording medium to a downstream side of the transport direction; a recorder that performs a recording operation on the transported recording medium with a recording head. The transporter includes the transport apparatus according to any one of the first to fourth aspects.

According to the fifth aspect of the invention, the transporter includes the transport apparatus according to anyone of claims 1 to 4. Therefore, the recording apparatus can achieve the same operation and effect as the aspect of anyone of claims 1 to 4.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an exemplary embodiment of the invention will be described in detail with reference to the accompanying drawings.

Figure 1:
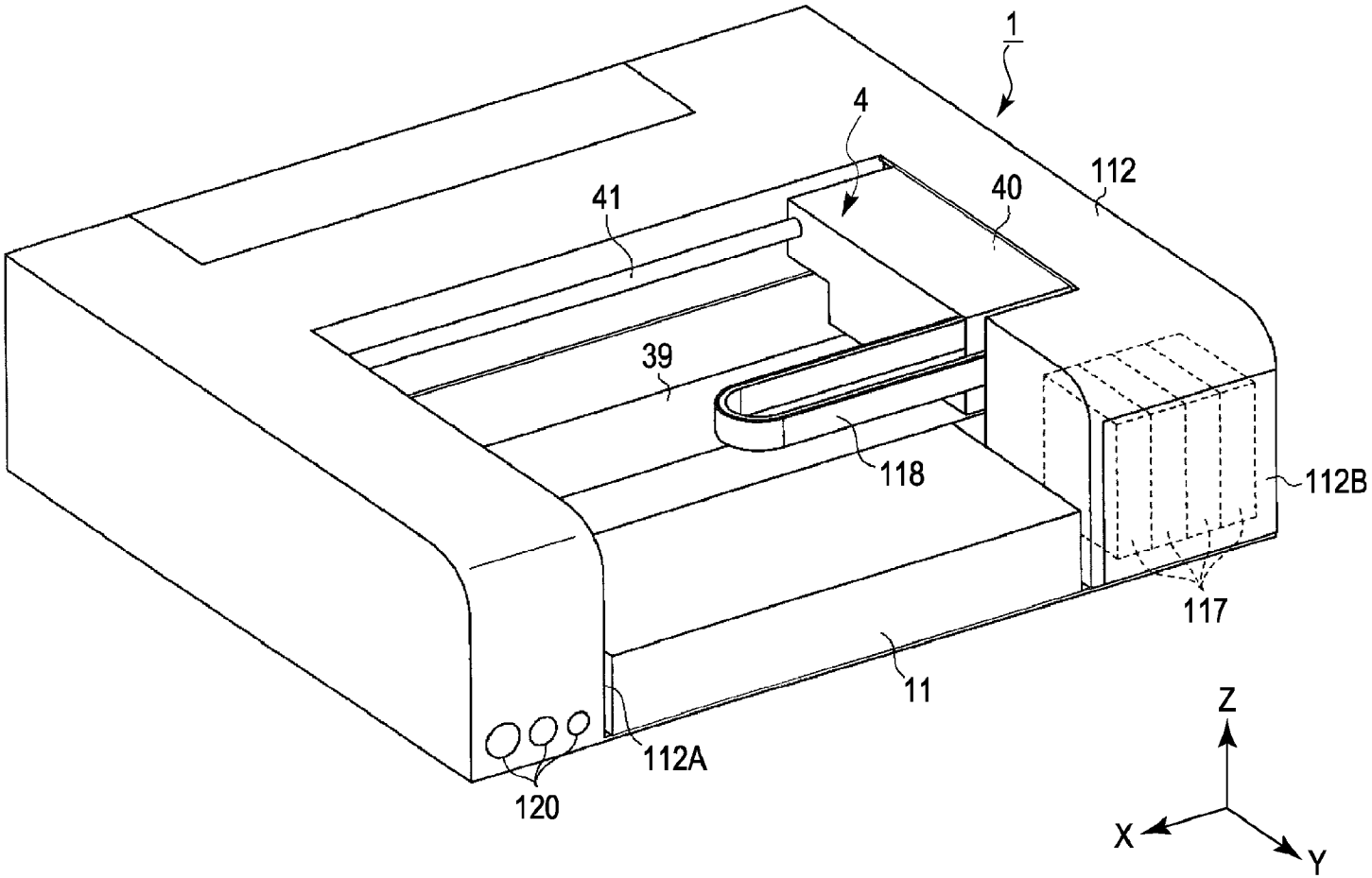
FIG. 1 is a perspective view illustrating the entire appearance of a printer related to the invention.

FIG. 1 is a perspective view illustrating a printer as an image forming apparatus related to an embodiment of the present invention.

As illustrated in FIG. 1, the printer 1 is a thin printer whose height in the Z direction is short. The printer 1 includes a rectangular box-shaped body 112, and a carriage 40 is provided reciprocally in a central region of the body 112 along the main scanning direction by being guided by a carriage guide shaft 41 extending along the right and left X direction (the main scanning direction) of FIG. 1.

As illustrated in FIG. 1, a long plate-like paper guide 39 is disposed opposite to the carriage 40 under the carriage 40 in parallel to the main scanning direction X in a central region of the body 112. A paper supply cassette 11 is provided on the lower front side (the front side of FIG. 1) of the printer 1 and is mounted (inserted) into a concave mount 112A formed in the body 112 and the front side is opened so that it can be inserted into the mount 112A. A plurality of ink cartridges 117 are loaded inside a cover 112B covering the right front surface of the body 112.

The ink in the ink cartridges 117 is supplied to the carriage 40 through a plurality of ink supply tubes (not shown) installed in a flexible wire plate 118, and ink droplets are ejected (discharged) from a recording head 42 (see FIG. 2) provided under the carriage 40. Pressure applying devices (piezoelectric devices, electrostatic devices, heat radiating devices, etc.) that apply pressure for ejecting the ink are installed in the nozzles of the recording head 42, and ink droplets are ejected (discharged) from the corresponding nozzles when a voltage is applied to the pressure applying devices.

A printing operation corresponding to one line is performed by ejecting ink droplets from the recording head 42 that is moving together with the carriage 40 in the main scanning direction with respect to the paper P supplied from the paper cassette 11 and located on the paper guide 39. The printing operation on the paper P is performed by alternately and repeatedly performing scanning operations of the carriage 40 and transporting the paper P to the following row. Various handling switches 120 including a power switch are provided on the lower left side of the body 112.

Figure 2:
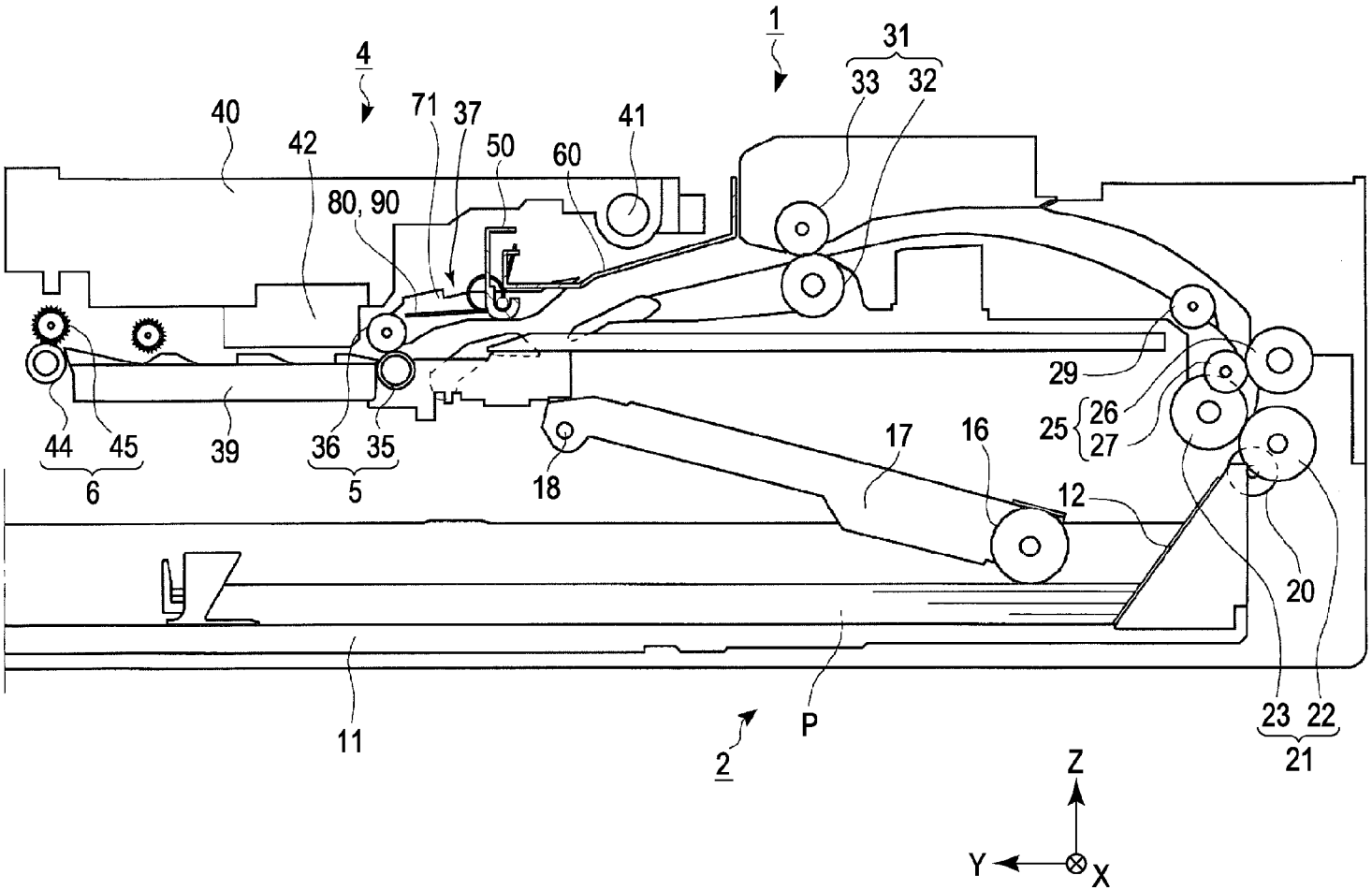
FIG. 2 is a side sectional view of a paper transport path of a printer according to an embodiment of the invention.

Hereinafter, the entire structure of the printer 1 will be described with reference to FIG. 2. The printer 1 includes a feeding unit 2 at the bottom of the device to feed the recording paper P from the feeding unit 2 sheet by sheet, perform an inkjet recording operation using a recorder 4, and discharge the recording paper P toward a paper discharge stacker (not shown) provided on the front side (the left side of FIG. 2) of the device.

The feeding unit 2 includes a paper cassette 11, a pickup roller 16, a guide roller 20, and a separator 21. The paper cassette 11 accommodating a plurality of sheets of stacked paper P can be mounted on and separated from the front side of the feeding unit 2 with respect to the body of feeding unit 2, and the pickup roller 16, which is driven and rotated by a paper feeding (PF) motor (not shown), is provided in a member 17 capable of being swung about a swing shaft 18 so that it comes in contact with the paper accommodated in the paper cassette 11 and rotates to withdraw the uppermost paper P from the paper cassette 11.

A separating member 12 is provided at a position opposite to the tip end of the paper P accommodated in the paper cassette 11, and the tip end of the uppermost paper P that is to be fed by sliding comes in contact with the separating member 12 to the downstream side to perform a first step of separating the uppermost paper P from the remaining paper P. A freely rotatable guide roller 20 is provided on the downstream side of the separating member 12, and the separator 21 including a separating roller 22 and a drive roller 23 to perform the second step of separating the paper P is additionally provided on the downstream side of the separating member 12.

A first middle feeder 25 including a drive roller 26 driven and rotated by the PF motor (not shown) and an assist roller 27 holding the paper P together with the drive roller 26 and driven and rotated by the drive roller 26 is provided on the downstream side of the separator 21, and the paper P is fed further to the downstream side of the separator 21 by the first middle feeder 25. The reference numeral 29 represents a driven roller that alleviates a paper passing load when the paper P (in particular, the rear end of the paper P) passes through a curved reversible path.

A second middle feeder 31 including a drive roller 32 driven and rotated by the PF motor (not shown) and an assist roller 33 holding the paper P together with the drive roller 32 and driven and rotated by the drive roller 32 is provided on the downstream side of the driven roller 29, and the paper P is fed further to the downstream side of the driven roller 29 by the second middle feeder 31.

A recorder 4 is disposed on the downstream side of the second middle feeder 31. The recorder 4 includes a transporter 5, a recording head 42, a paper guide 39, and a discharger 6. The transporter 5 includes a drive transport roller 35 driven and rotated by the PF motor (not shown) and a driven transport roller 36 whose shaft is supported by a paper guide box 37 and which is pressed, driven and rotated by the drive transport roller 35, and the paper P is precisely fed toward a position opposing the recording head 42 by the transporter 5.

The recording head 42 is provided at the bottom of the carriage 40 which is guided by a carriage guide shaft 41 extending in the main scanning direction (the direction perpendicular to the paper surface of FIG. 2) and is reciprocally driven in the main scanning direction by a carriage (CR) motor (not shown). The paper guide 39 is provided at a position opposing the recording head 42, and the distance between the paper P and the recording head 42 is defined by the paper guide 39.

The discharge unit 6 provided on the downstream side of the paper guide 39 includes a drive discharge roller 44 driven and rotated by the PF motor (not shown) and a driven discharge roller 45 driven and rotated while making contact with the drive discharge roller 44, and the paper P on which a recording operation is performed by the recorder 4 is discharged to a stacker (not shown) provided on the front side of the device by the discharge unit 6.

Figure 3:
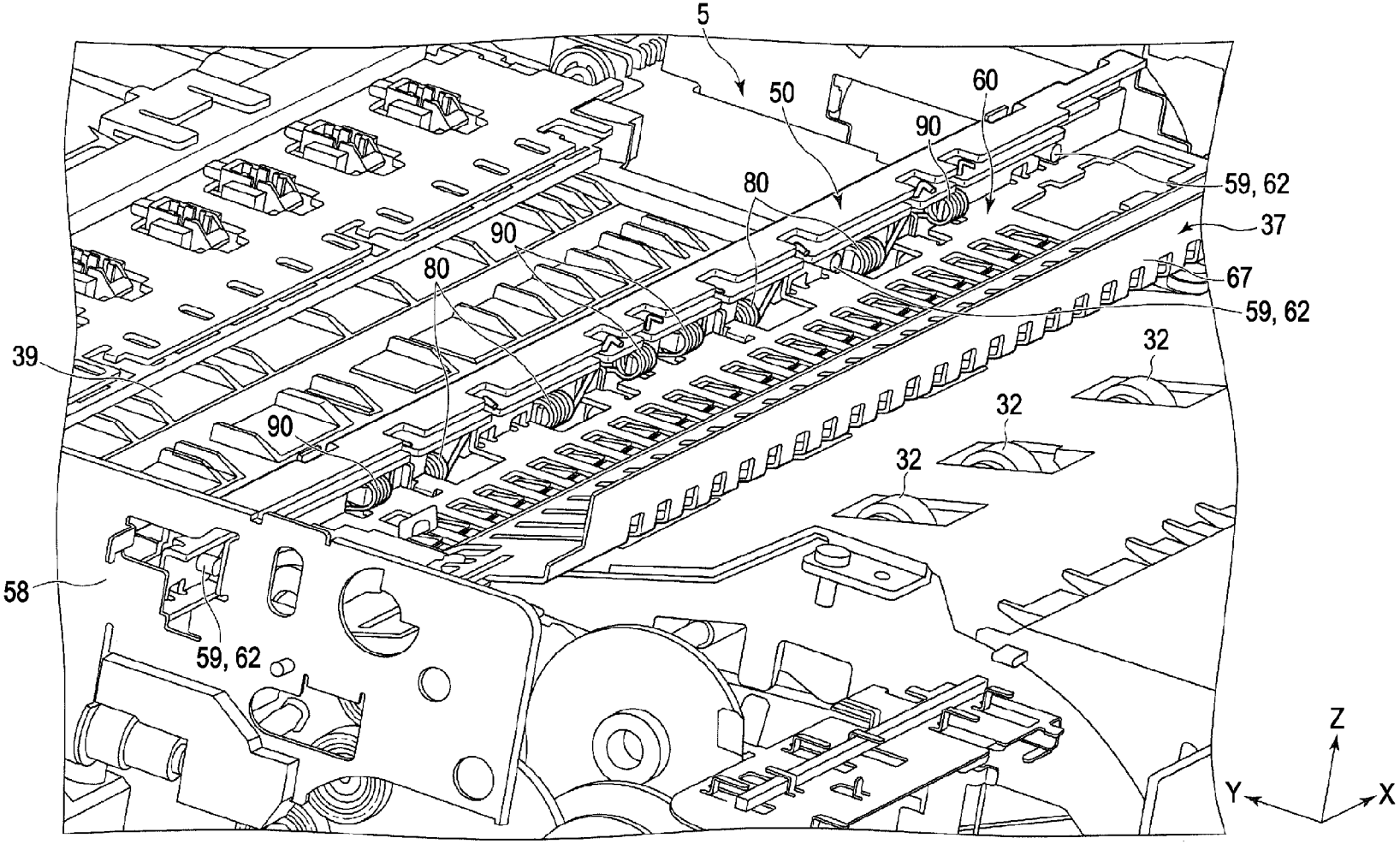
FIG. 3 is a rear perspective view illustrating a main frame and a rear frame of the printer according to the embodiment of the invention.
Figure 4:
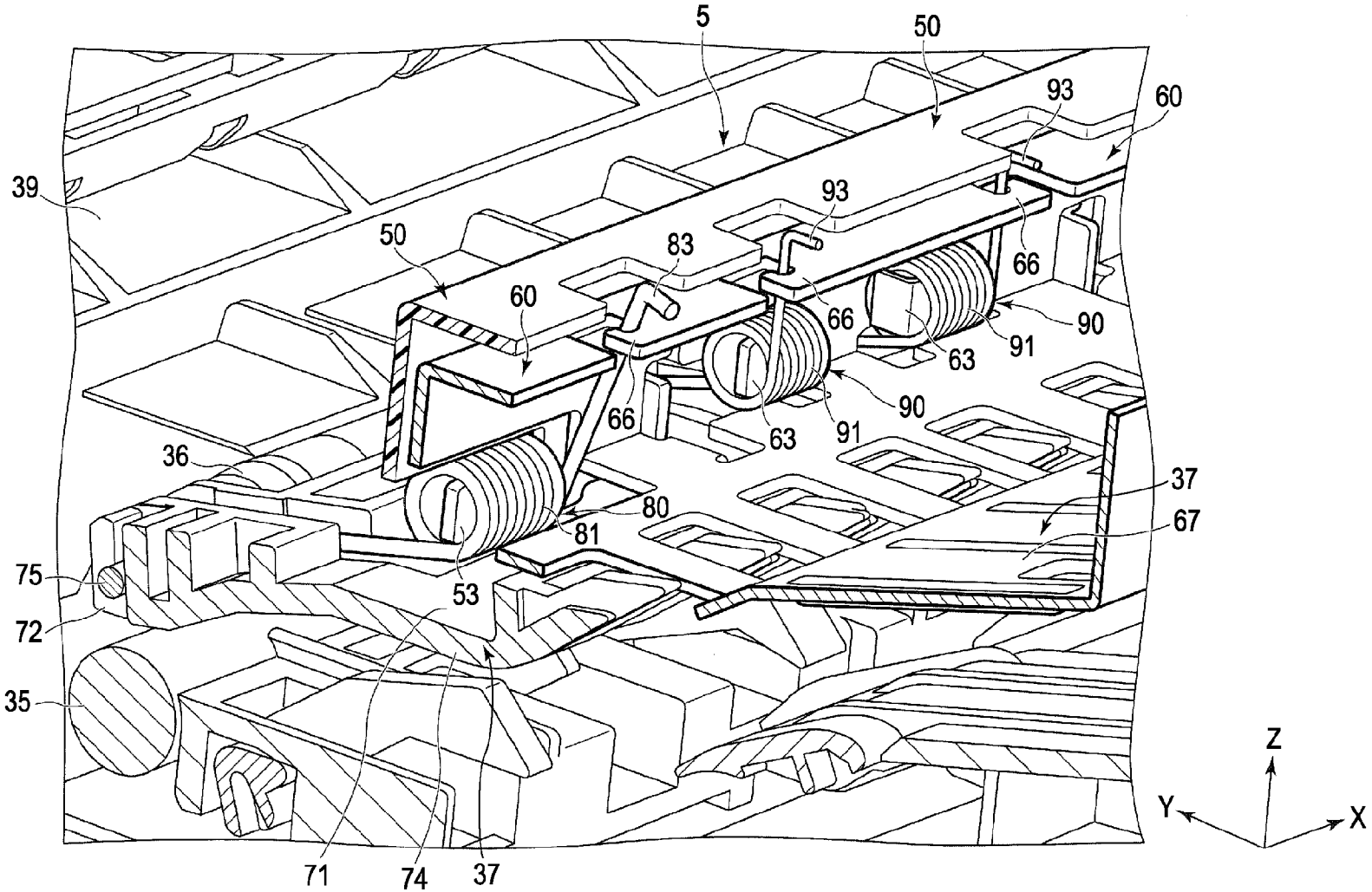
FIG. 4 is an enlarged rear cross-sectional perspective view illustrating a transporter according to the embodiment of the invention.
Figure 5:
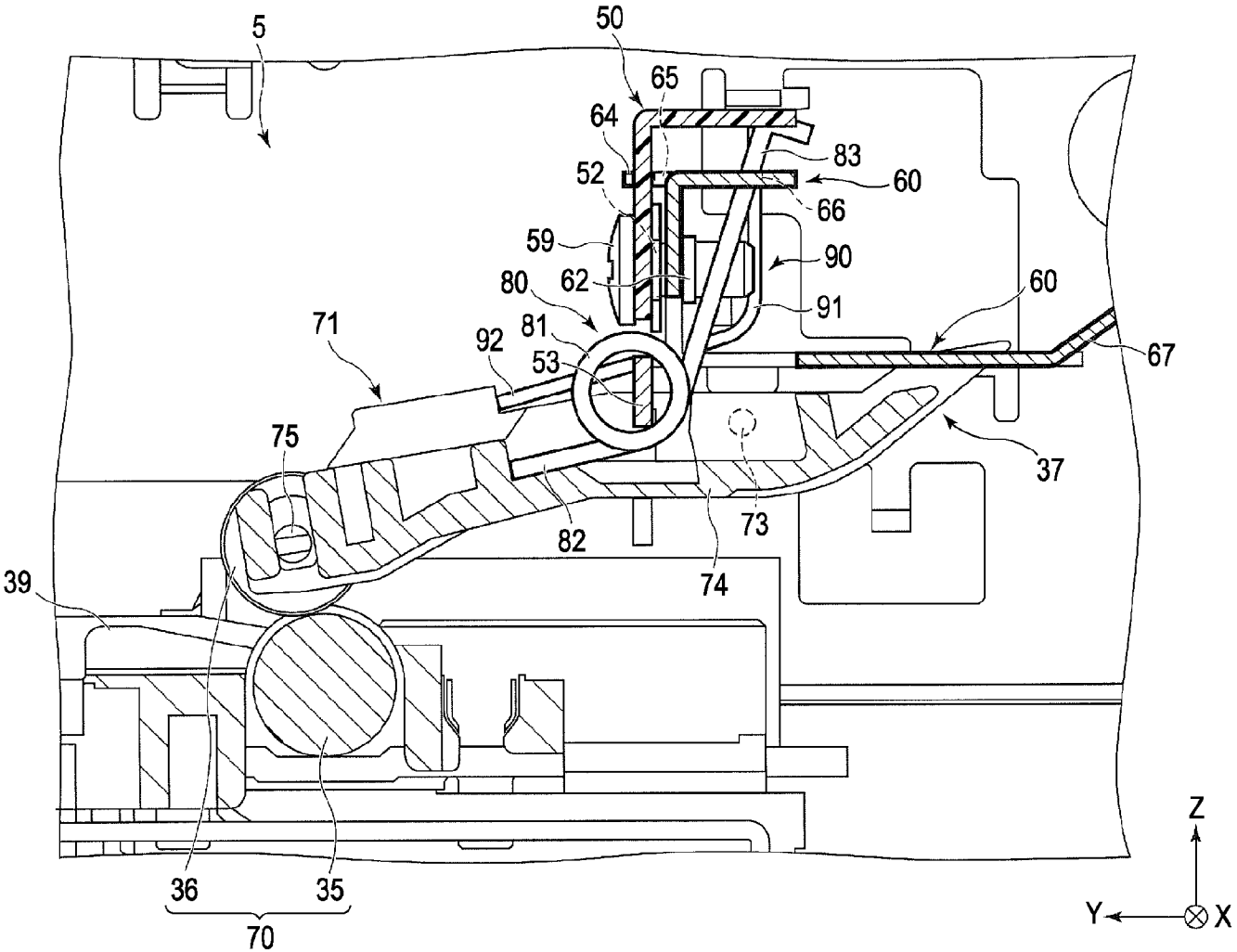
FIG. 5 is an enlarged side sectional view illustrating the transporter according to the embodiment of the invention.
Figure 6:
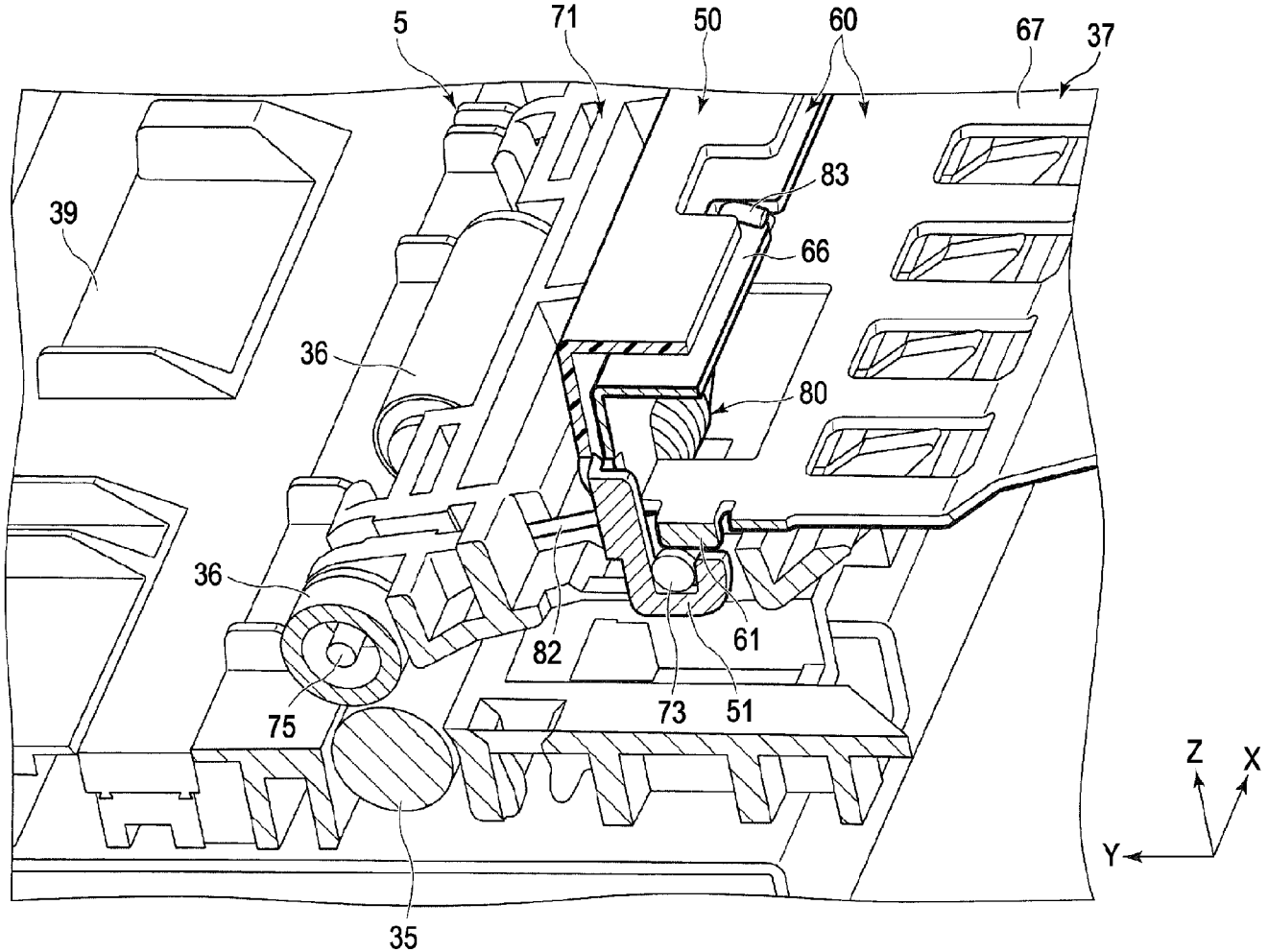
FIG. 6 is an enlarged side perspective view illustrating the transporter according to the embodiment of the invention.
Figure 7:
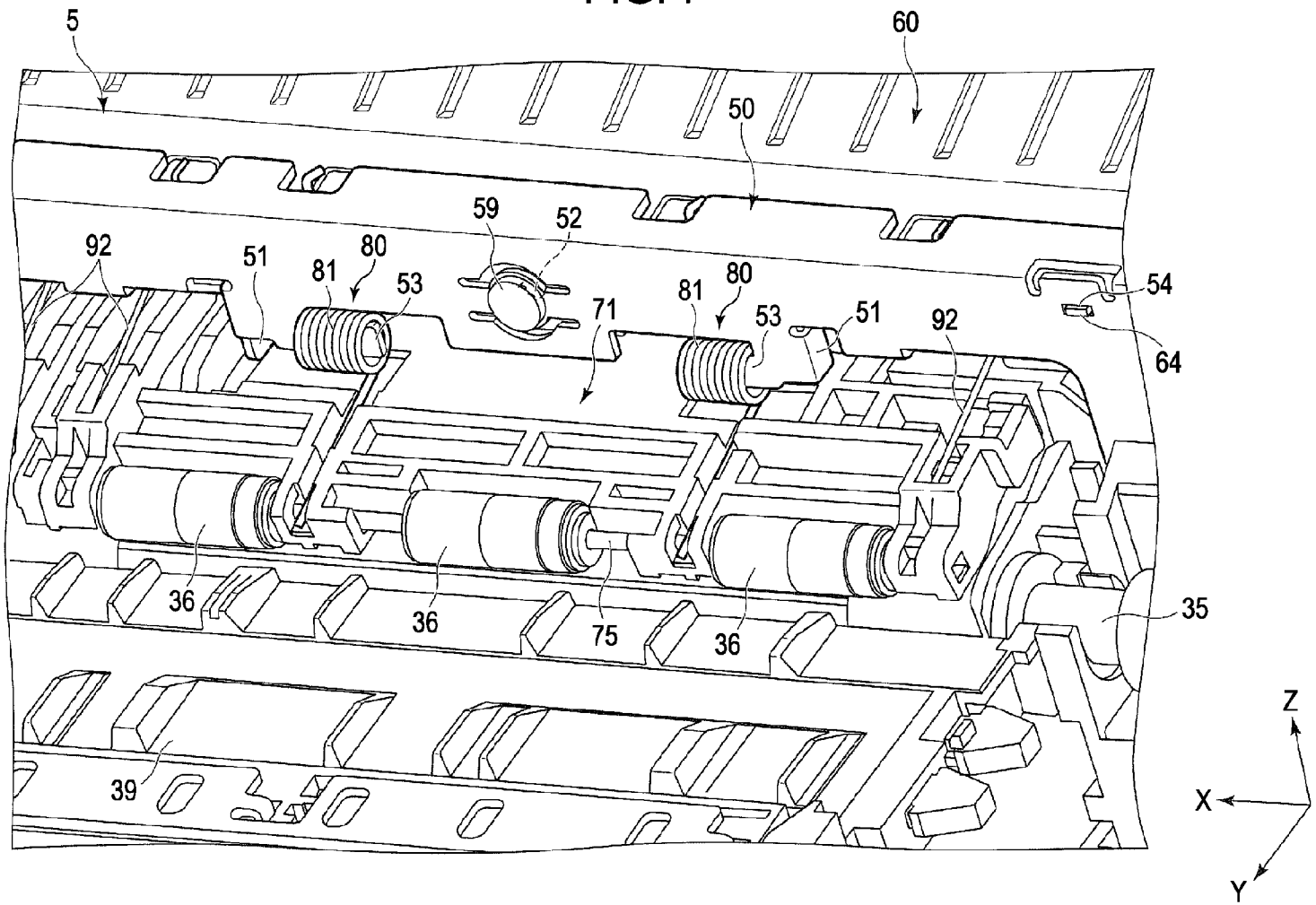
FIG. 7 is an enlarged front perspective view illustrating the vicinity of the transporter according to the embodiment of the invention.
Figure 8:
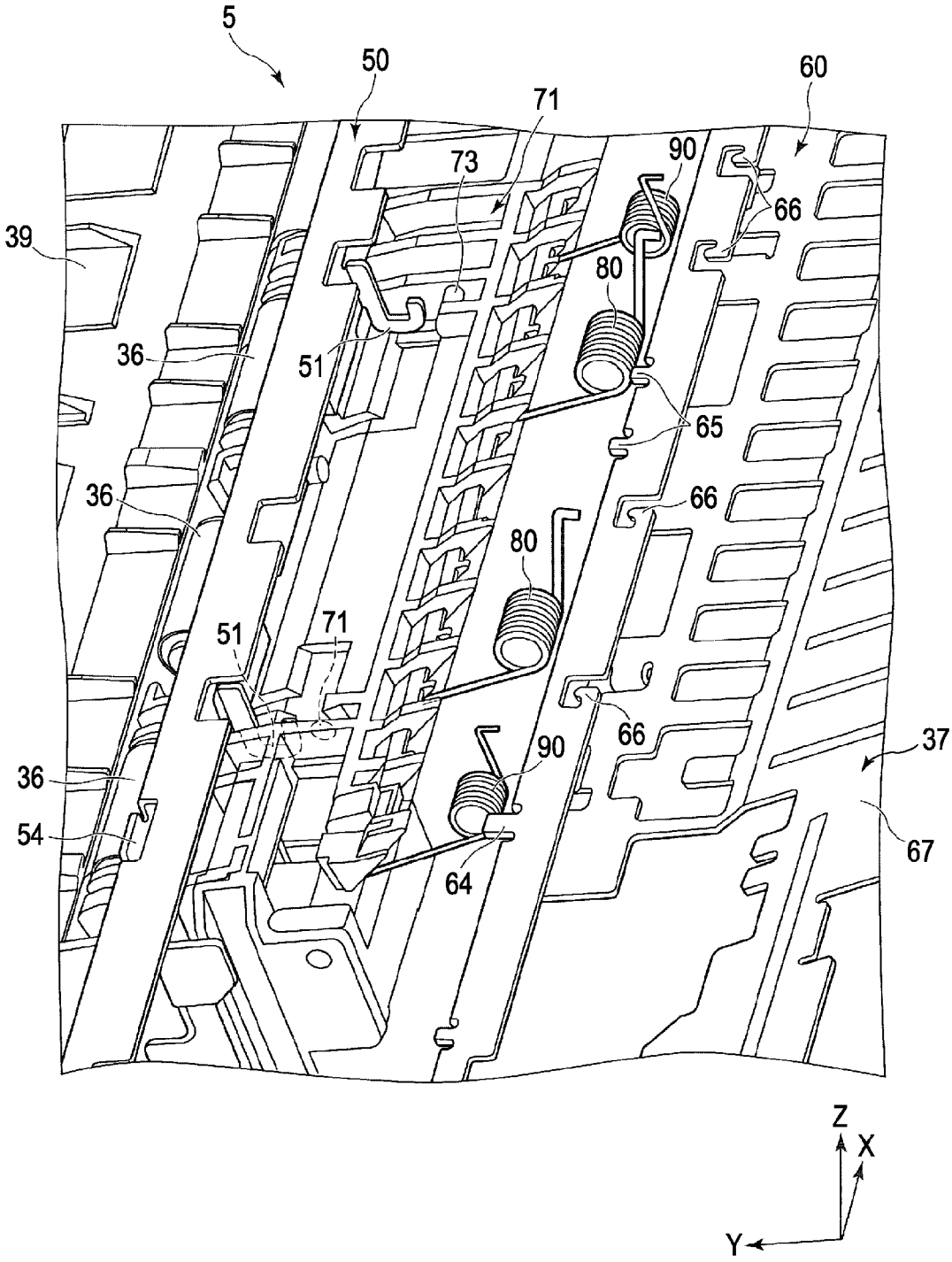
FIG. 8 is an exploded perspective view illustrating the transporter according to the embodiment of the invention.

FIG. 3 is a rear perspective view illustrating a main frame and a rear frame of the printer according to the embodiment of the invention. FIG. 4 is an enlarged rear cross-sectional perspective view illustrating a transporter according to the embodiment of the invention. FIG. 5 is an enlarged side sectional view illustrating the transporter according to the embodiment of the invention. FIG. 6 is an enlarged side perspective view illustrating the transporter according to the embodiment of the invention. FIG. 7 is an enlarged front perspective view illustrating the vicinity of the transporter according to the embodiment of the invention. FIG. 8 is an exploded perspective view illustrating the transporter according to the embodiment of the invention.

As illustrated in FIGS. 3 to 8, the transporter 5 of the printer 1 includes a main frame 50 and a rear frame 60. The main frame 50 is integrally mounted on a body 58 of the printer 1. The rear frame 60 is installed behind the main frame 50. As will be described in detail later, the rear frame 60 comes in point-contact with the main frame 50 at a plurality of places. The rear frame 60 includes a first paper box guide 67 forming a portion of the paper guide box 37 on the upper side of the paper guide path.

In the embodiment of the invention, the main frame 50 is formed of a resin such as plastic. On the other hand, the rear frame 60 is formed of a metal plate, i.e. a sheet metal.

The transporter 5 includes a transport roller unit 70, a driven roller holder 71, a driven roller shaft 75, first torsion coil springs 80, second torsion coil springs 90, a main frame 50, and a rear frame 60. The transport roller unit 70 includes a drive transport roller 35 driven by the power of a transport motor and driven transport rollers 36 driven and rotated by the drive transport roller 35. The driven transport rollers 36 are mounted on a driven roller shaft 75 and are held to be rotatable by roller bearings 72 of the driven roller holder 71. The driven transport rollers 36 are urged toward the drive transport roller 35 by the first torsion coil springs 80 and the second torsion coil springs 90.

In the embodiment of the invention, one drive roller holder 71 maintains three rotatable driven transport rollers 36. A plurality of driven roller holders 71 are provided in the widthwise direction X of the recording paper P. Two first torsion coil springs 80 and two second torsion coil springs 90 are provided for one driven roller holder 71. Hereinafter, one unit for one driven roller holder 71 will be described.

The first torsion coil springs 80 include first coils 81, first spring arms 82 urging the driven transport rollers 36, and second spring arms 83 engaging with the rear frame 60.

Similarly, the second torsion coil springs 90 include second coils 91, third spring arms 92 urging the driven transport rollers 36, and fourth spring arms 93 engaging with the rear frame 60.

The first coils 81 of the first torsion coil springs 80 are maintained by first coil maintainers 53 formed in the main frame 50. The first spring arms 82 urge the driven transport rollers 36 through the driven roller shaft 75 by making contact with the driven roller shaft 75 (see FIG. 7). The second spring arms 83 engage with spring arm engagers 66 formed in the rear frame 60.

Here, since an urging force is applied to the first spring arms 82, an urging force is applied to the second spring arms 83 engaging with the spring arm engagers 66. Since an urging force is applied to the first spring arms 82 in the counterclockwise direction about the first coils 81 in FIG. 5, an urging force is applied to the second spring arms 83 in the clockwise direction.

In addition, since the first spring arms 82 come in contact with the driven roller shaft 75 to urge the driven roller shaft 75 in the embodiment of the invention, almost none of the forces of the first torsion coil springs 80 are applied to holder shafts 73 and holder shaft receivers 51.

Meanwhile, the second coils 91 of the second torsion coil springs 90 are maintained by the second coil maintainers 63 formed in the rear frame 60. The third spring arms 92 urge the driven transport rollers 36 through the driven roller holder 71 by making contact with the driven roller holder 71 (see FIG. 7). The fourth spring arms 93 engage with the spring arm engagers 66 of the rear frame 60.

Here, an urging force is applied to the third spring arms 92 and an urging force is applied to the fourth spring arms 93 engaging with the spring arm engagers 66. That is, since an urging force is applied to the third spring arms 92 in the clockwise direction about the second coils 91, an urging force is applied to the fourth spring arms 93 in the reverse direction.

Since the second spring arms 92 urge the driven roller shaft 75 by making contact with the vicinity of the driven roller shaft 75, almost none of the forces of the second torsion coil springs 90 are applied to the holder shaft 73 and the holder shaft receivers 51.

A second paper box guide 74 guiding the upper side of the paper P is formed on the bottom surface of the driven roller holder 71. That is, the above-described paper guide box 37 includes a first paper box guide 67 of the rear frame 60 and a second paper box guide 74 (see FIG. 5) of the driven roller holder 71.

Moreover, a pair of holder shafts 73 (see FIGS. 6 and 8) are formed in the driven roller holder 71. The holder shafts 73 are maintained to be rotatable by a pair of holder shaft receivers 51 formed in the main frame 50 in a J-shape. Therefore, the driven roller holder 71 can be swung about the holder shafts 73.

Specifically, when thick paper is transported, the driven roller holder 71 is swung in the clockwise direction in FIG. 5 about the holder shafts 73 against the urging forces of the first torsion coil springs 80 and the second torsion coil springs 90 together with the driven transport rollers 36.

That is, the locations of the driven roller holder 71 and the driven transport roller 36 are determined by the main frame 50. The loads (urging forces) of the first torsion coil springs 80 and the second torsion coil springs 90 are received by the main frame 50 and the separate rear frame 60.

Withdrawal preventers 61 (see FIG. 6) are provided in the rear frame 60. The withdrawal preventers 61 prevent the holder shafts 73 from being withdrawn from the holder shaft receivers 51 in the J-shaped release sides of the holder shaft receivers 51.

The rear frame 60 is mounted on the main frame 50 by screws 59.

Specifically, a plurality of screw insert holes 52 are provided in the main frame 50. A plurality of female screw holes 62 are provided in the rear frame 60 at positions opposing the plurality of screw insert holes 52. A plurality of screws 59 are inserted into the screw insert holes 52 from the main frame 50 and are screw-coupled to the screw holes 62.

Cuts are formed in the vicinity of the screw insert holes 52 of the main frame 50 to resiliently deform the vicinity of the screw insert holes 52. That is, the vicinity of the screw insert holes 52 of the main frame 50 is cushioned.

Here, the first convex portions 64 and second convex portions 65 are provided in the rear frame 60 (see FIG. 8). Meanwhile, engaging holes 54 are provided in the main frame 50. The first convex portions 64 engage with the engaging holes 54. The locations of the main frame 50 and the rear frame 60 in the X and Z directions can be relatively determined by the engagement.

The plurality of second convex portions 65 comes in point-contact with the main frames 50 at a plurality of positions (see FIG. 5).

Here, as described above, the rear frame 60 can be introduced into the main frame 50 by the resilient deformation due to the cuts in the vicinity of the screw insert holes 52, making contact with the second convex portions 65 only at points.

It is apparent that the second convex portions 65 may be provided in the main frame 50.

Therefore, the relative positions of the main frame 50 and the rear frame 60 in the Y direction can be determined.

Further, using the points of contact, the deflection of the rear frame 60 by the forces from the second spring arms 83 and the fourth spring arms 93 does not influence the main frame 50.

As a result, the X, Y, and Z directional positions and alignments of the driven roller holder 71 and the driven transport roller 36 determined by the main frame 70 can be stabilized.

As described above, the positions of the driven roller holder 71 and the driven transport rollers 36 are determined by the main frame 50. The spring loads (urging forces) of the first torsion coil springs 80 and the second torsion coil springs 90 are received by the rear frame 60 separately from the main frame 50. In other words, the main frame 50 and the rear frame 60 are provided separately from each other to share with each other the function of determining positions and the function of receiving loads.

The positions of the driven transport roller 36 with respect to the drive transport roller 35 may be precisely determined by the structure. Therefore, the transport precision of the paper can be stabilized. The separate provision of the main frame 50 and the rear frame 60 is particularly effective for a layout of the printer 1 made thin in the Z direction by providing the main frame 50 to be long in the Z direction.

Here, the main frame 50 does not directly bear the urging forces of the first torsion coil springs 80 and the second torsion coil springs 90. Therefore, the main frame 50 may be formed of a resin such as plastic instead of a metal sheet. In this case, the weight of the main frame 50 may be decreased as compared with the case of a metal sheet.

Although the first coil springs 80 and the first coils 81 are maintained by the first coil maintainers 53 of the main frame 50 in the embodiment of the invention, they may be maintained by the rear frame 60 as in the second coils 91 of the second torsion coil springs 90. In this case, the urging forces of the first torsion coil springs 80 and the second torsion coil springs 90 indirectly applied to the main frame 50 can be reduced further.

As described above, the paper guide box 37 includes a first paper box guide 67 of the rear frame 60 and the second paper box guide 74 (see FIG. 5) of the driven roller holder 71. Here, only the second paper box guide 74 of the paper guide box 37 is swung about the holder shafts 73. Therefore, as compared with the case in which the paper guide boxes of the first paper box guide and the second paper box guide are integrally swung, the displacement of the member in the Z direction can be reduced. As a result, the printer 1 can be made thinner in the Z direction. Therefore, this structure is especially effective for a printer 1 that is made thin in the Z direction.

Moreover, the screws 59 are fixed and the second convex portions 65 make points of contact at widthwise positions where the first torsion coil springs 80 and the second torsion coil springs 90 are not provided. Therefore, the deflection of the rear frame 60 rarely influences the main frame 50.

The transporter 5 which is a transport apparatus according to the embodiment of the invention includes a transport roller unit 70 having a drive transport roller 35 and driven transport rollers 36 to feed recording paper P as an example of a transported medium to a downstream side in the transport direction, and a driven roller holder 71 maintaining the driven transport rollers 36 to be rotatable, a main frame 50 as a support member supporting the driven roller holder 71 while allowing it to swing, first torsion coil springs 80 and second torsion coil springs 90 that are examples of a load applying resilient member for applying a load to the driven transport rollers 36 by resilient deformation in a direction along which the driven transport roller 36 approaches the drive transport roller 35, and a rear frame 60 provided separately from the main frame 50 to bear the load by engaging with the first torsion coil springs 80 and the second torsion coil springs 90.

In the embodiment of the invention, the main frame 50 is formed of a resin.

Moreover, in the embodiment of the invention, the load applying resilient member has a plurality of first torsion coil springs 80 and a plurality of second torsion coil springs 90.

The first spring arms 82 and the third spring arms 92, i.e. the ends at one side of the first torsion coil springs 80 and the second torsion coil springs 90, engage with the driven transport rollers 36 about the holder shafts 73, i.e. the swing point of the driven roller holder 71, and the second spring arms 83 and the fourth spring arms 93, i.e. the other ends thereof engage with the rear frame 60.

In the embodiment of the invention, second convex portions 65 are formed in at least one of the rear frame 60 and the main frame 50 and the rear frame 60 and the main frame 50 make points of contact with each other at the second convex portions 65.

The printer 1, i.e. the recording apparatus according to the embodiment of the invention includes a feeder 2 that picks up and feeds recording paper P as a feeder, i.e. an example of a loaded recorded medium, a transporter 5 that transports the fed recording paper P to a downstream side of the transport direction, and a recorder 4 that performs a recording operation as a recorder on the transported recording paper P by the recording head 42.

Although an exemplary embodiment of the invention has been described with reference to the accompanying drawings, it should be understood that the invention is not limited to such embodiments. Various shapes or combinations of the respective constituent elements illustrated in the above-described embodiments are merely examples, and various changes may be made depending on design requirements or the like without departing from the spirit or scope of the invention.

What is claimed is:

1. A transport apparatus comprising:

a transport roller unit that includes a drive transport roller and a driven transport roller to transport a transported medium to a downstream side of a transport direction; a driven roller holder that rotatably holds the driven transport roller;

a support member comprising a first frame member that supports the driven roller holder and allows the driven roller holder to swing;

a load applying resilient member comprising a torsion coil spring that applies a load to the driven transport roller by a first end of the torsion coil spring engaging with the driven transport roller and being resiliently deformed in a direction along which the driven transport roller approaches the drive transport roller, wherein a plurality of coils of the torsion coil spring are maintained by a coil maintainer formed in the first frame member; and an engaging member comprising a second frame member that is provided separately from the support member to ensure a position of the transport roller unit and to bear the load applied to the driven transport roller by engaging with a second end of the torsion coil spring of the load applying resilient member which is also resiliently deformed when the load is applied to the driven transport roller.

2. The transport apparatus according to claim 1, wherein the support member is formed of a resin.

3. The transport apparatus according to claim 1, wherein the load applying resilient member has a plurality of torsion coil springs, and wherein one end of each of the torsion coil springs engage with the driven roller holder on a side close to the driven transport roller, and the other end of each of the torsion coil springs engage with the engaging member.

4. The transport apparatus according to claim 1, wherein a convex portion is formed in the engaging member, and the engaging member and the support member make a point of contact with each other at the convex portion.

5. A recording apparatus, comprising:

a feeder that picks up a loaded recording medium and feeds the recording medium;

a transporter that transports the fed recording medium to a downstream side of the transport direction;

a recorder that performs a recording operation on the transported recording medium with a recording head, wherein the transporter includes the transport apparatus according to claim 1.

* * * * *